United States Patent [19]

Pennella

[11] Patent Number: 4,848,385

[45] Date of Patent: Jul. 18, 1989

[54] LIGHTING PORTABLE UTENSIL FORMING AN UMBRELLA, SUNSHADE OR THE LIKE

[76] Inventor: Benito V. U. Pennella, 11 Curso Meridionale, Naples, Italy

[21] Appl. No.: 128,156

[22] Filed: Dec. 3, 1987

[51] Int. Cl.[4] ..... A45B 3/00

[52] U.S. Cl. ..... 135/16; 135/DIG. 10

[58] Field of Search ..... 135/16, 355, DIG. 10, 135/DIG. 11, 91

[56] References Cited

U.S. PATENT DOCUMENTS

| | | | |
|---|---|---|---|
| 1,707,473 | 4/1929 | Goldberg | 135/DIG. 10 |
| 2,993,216 | 7/1961 | Casey | 135/91 |
| 3,802,451 | 4/1974 | Morris | 135/35.5 |
| 3,870,062 | 3/1975 | Medlin | 135/DIG. 10 |
| 4,020,858 | 5/1977 | Wilson | 135/DIG. 10 |
| 4,031,381 | 6/1977 | Carver | 135/DIG. 10 |

FOREIGN PATENT DOCUMENTS

| | | | |
|---|---|---|---|
| 1032053 | 6/1953 | France . | |
| 1134037 | 4/1957 | France . | |
| 2040676 | 1/1971 | France . | |
| 2165698 | 8/1973 | France . | |
| 631609 | 8/1982 | Switzerland | 135/DIG. 10 |
| 2113543 | 8/1983 | United Kingdom . | |

*Primary Examiner*—Henry E. Raduazo

*Attorney, Agent, or Firm*—Steinberg & Raskin

[57] ABSTRACT

A lighting portable utensil forming an umbrella, sunshade or the like and having a stick carrying at one end thereof a cupola kept in open unfolded position by flexible ribs or whale bones made from a transparent material and lit by a light source provided in the vicinity of the point of convergence of the whale bones which thus provide for the guiding and diffusion of light.

11 Claims, 1 Drawing Sheet

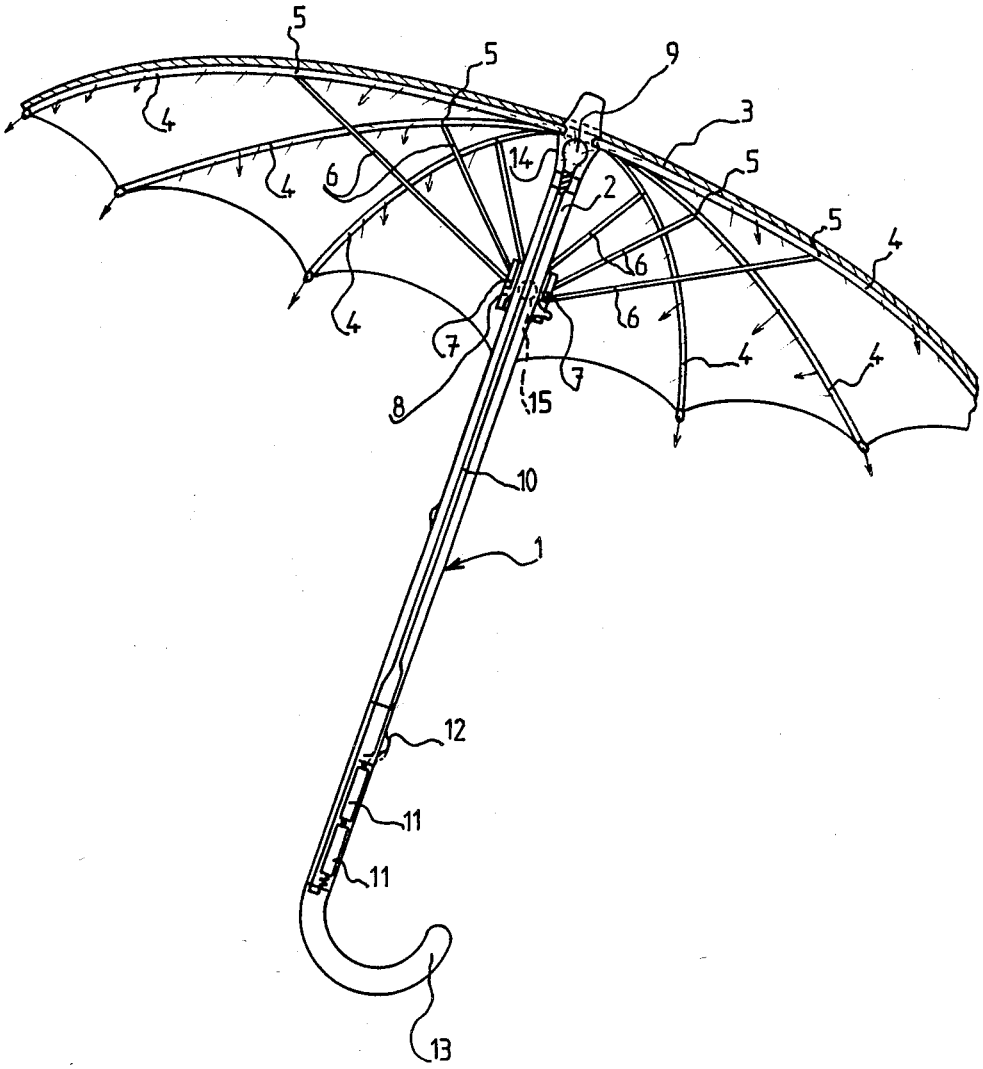
5
5
9
3
4
4
6
14
2
5
5
4
6
6
4
7
7
4
4
8
15
10
1
12
11
11
13

LIGHTING PORTABLE UTENSIL FORMING AN UMBRELLA, SUNSHADE OR THE LIKE

BACKGROUND OF THE INVENTION

The present invention relates to a portable utensil or implement forming an umbrella, sunshade or the like.

Utensils of the above-mentioned kind have been known for a very long time and are adapted to protect against bad weather or the sun.

These implements however are not particularly attractive and generally do not have other functions than protection from rain or the sun.

SUMMARY OF THE INVENTION

The invention therefore is directed to imparting to this type of utensil a lighting or illuminating function which is particularly useful when used at night and which, at the same time, provides a particularly aesthetic and attractive appearance of the utensile.

For this purpose, the object of the invention is to provide a portable utensile forming an umbrella, sunshade or the like and of the type comprising a stick or handle carrying at, one of its ends a, cover which may be kept in an open displayed or unfolded position by a frame consisting of flexible and/or stiff ribs or whale bones, characterized in that at least one part of the ribs or whale bones of the frame are made from a transparent material whereas a light source is provided in the vicinity of the point of convergence of these ribs of transparent material which thus provide for the guidance and diffusion of light.

It is therefore understandable that the umbrella or sunshade frame would perform the function of a light diffusing guide enabling the persons using the umbrella by night to light it up without uselessly complicating the usual structure of the umbrella.

According to another characterizing feature of the invention, the light source consists of at least one electric bulb made fast with that end of the handle or stick which is immediately underneath the cover at the point of convergence of the ribs or whale bones of transparent material which are connected to said cover.

According to still another characterizing feature of the invention, the light source is supplied with electric current by a wiring extending within the stick and connected to batteries or the like preferably accommodated or housed within said stick or handle.

It should be pointed out that there is provided a switch which is mounted on the stick or handle at the end thereof.

According to a preferred embodiment, said light source or electric bulb is accommodated within a transparent socket interposed between the cover and the end of the stick, this socket being preferably removably secured to the stick.

The ribs or whale bones and possibly the stick are made from a suitable synthetic transparent material providing for the guidance and the diffusion of the light such as for instance plexiglass.

According to still another characterizing feature of the invention, to the ribs or whale bones of transparent material secured to the underside of the cover are pivotally connected rigid rods or the like of a metallic or transparent material themselves pivotally connected to a bush sliding on the stick.

Within the scope of the invention, there may be provided another light source housed within the stick at the point of locking of the bush onto the stick.

Thus, not only the whale bones of the umbrella or sunshade may be lit or illuminated, but also the rods pivotally connected between the whale bones and the bush sliding on the stick so that the whole frame consisting of the whale bones and the rods may be used as a light guide and diffuser thereby further increasing the lighting capabilities while improving the aesthetic appearance.

BRIEF DESCRIPTION OF THE DRAWING

The invention will be better understood and further objects, characterizing features, details and advantages thereof will appear more clearly as the following explanatory description proceeds with reference to the accompanying diagrammatic drawing given by way of non-limiting example only and wherein the single FIGURE shows in sectional and perspective view an umbrella according to the principles of the invention.

DESCRIPTION OF THE PREFERRED EMBODIMENT

Referring to the single FIGURE, there is shown an umbrella of conventional type, i.e. comprising a handle or stick 1 which carries at one 2 of its ends a cover 3 made from an impervious cloth or fabric. This cover is foldable and may be kept in an open displayed or unfolded position owing to a frame consisting essentially of flexible ribs or whale bones 4.

Onto the latter are pivotally connected at 5 rods 6 themselves pivotally connected at 7 onto a bush 8 slidable along the stick 1 for closing or opening the umbrella.

All the above-mentioned features are well known and need not be further described in greater detail.

According to the invention, there is provided a light source such for instance as an electric bulb 9 at the point of convergence of the whale bones 4 which are made from a suitable synthetic transparent material such for instance as a material known under the name "Plexiglass".

The electric bulb 9 is preferably located just below the cover 3, i.e. at the point of convergence of the whale bones 4 which are secured to the underside of said cover.

The electric bulb 9 is connected through a wiring 10 embedded or nested within the stick 1 to a supply of electric current consisting for instance of a bank or set of batteries 11 also housed within the stick 1 which, like the whale bones 4, may also be made from a synthetic transparent material.

A switch 12 for operating the lighting off or putting on the electric bulb 9 is provided on the stick 1. This switch could quite well, without leaving the scope of the invention, be provided on the handle or grip 13 of the umbrella for instance at the free end of this grip or handle.

According to a preferred embodiment, the electric bulb 9 is accommodated within a transparent socket 14 interposed between the cover 3 and the end 2 of the stick 1. The socket 14 may be removably secured for instance by screwing onto the end 2 of the stick thereby allowing removal of the stick and changing or replacing the bulb, as is well understandable.

Without leaving the scope of the invention, there may be provided another electric bulb within the stick 1, this bulb being diagrammatically shown at 15 and being located at the point of locking of the bush 8 to provide for the locking of the umbrella in open position.

This electric bulb would light or illuminate the bush 8 which may be made from a transparent plastics material as well as the rods 6 which may also be made from a transparent material.

More specifically, there is seen in the FIGURE that the electric bulb 15 is located at the point of convergence of the rods 6 and likewise the electric bulb 9 is located at the point of convergence of the whale bones 4.

The operation and the advantages of the umbrella or sunshade are inferrable or derivable directly from the foregoing description.

After having opened the device, the user would operate the switch 12 to thereby light the electric bulb 9 and possibly the electric bulb 15 if the latter is provided.

Thus, the light would be propagated within the whale bones 4 and possibly within the rods 6 beneath the canopy, cupola or cover 3. The umbrella would then provide a lighting or illumination to the user who would thus be reassured by night as is well understandable. Moreover, the lighting of the whale bones 4 and the rods 6 would impart a particularly attractive aesthetic appearance to the umbrella.

It should be understood that the invention is not at all limited to the embodiment described and shown which has been given by way of illustrative example only.

Thus, the invention is applicable to any known kinds of utensils of the umbrella, sunshade or the like type irrespective of whether the cupola or canopy is foldable or not and whatever the selected type of frame may be.

Likewise, the cross-section and the material of the whale bones and possibly of the rods providing for the guidance and diffusion of light may be of any nature whatsoever. In this respect, the outside surface of the whale bones and rods may be suitably treated or processed to provide for a good diffusion of light under the cupola or canopy hence a good lighting of the user and of the ground.

Therefore, the invention comprises all the technical equivalents of the means described as well as their combinations if same are carried out according to its gist.

What is claimed is:

1. A portable utensil forming an umbrella, sunshade or the like, of the kind comprising a stick carrying at one end a cover which may be kept in an open unfolded position by a frame comprising circumferentially spaced ribs secured to said cover and converging towards a point of convergence near said end of said stick, wherein the improvement comprises at least one part of the ribs of the frame are made from a transparent material and a light source emitting light is provided in the vicinity of said point of convergence of the ribs of transparent material which thus provide for the guiding and diffusion of the light.

2. A utensil according to claim 1, wherein said light source comprises at least one electric bulb secured to said end of said stick which is just below said cover at said point of convergence of said ribs of transparent material.

3. A utensil according to claim 1, wherein said light source is supplied with electric current through a wiring extending within said stick and connected a power source accomodated within said stick.

4. A utensil according to claim 1, which further comprises a switch secured to said stick.

5. A utensil according to claim 2, wherein said electric bulb is accomodated within a transparent socket interposed between said cover and said end of said stick, this socket being removably secured to the stick.

6. A utensil according to claim 1, wherein said ribs and said stick are made from a suitable transparent synthetic material to provide for the guiding and diffusion of light.

7. A utensil according to claim 2, wherein said ribs of transparent material are secured to an underside of said cover and are pivotally connected to rigid rods which are themselves pivotally connected to a bush slidable on said stick.

8. A utensil according to claim 7, which further comprises a point of locking of said bush onto said stick, and another light source housed within said stick at said point.

9. A utensil according to claim 3, wherein the power source comprises batteries.

10. A utensil according to claim 1, wherein said stick comprises an opposite end and including a handle mounted at said opposite end and a switch secured to said handle.

11. A utensil according to claim 6, wherein said suitable synthetic material is plexiglass.

* * * * *